US009283787B2

(12) United States Patent
Shiota

(10) Patent No.: US 9,283,787 B2
(45) Date of Patent: Mar. 15, 2016

(54) RECORDING APPARATUS

(71) Applicant: SEIKO EPSON CORPORATION, Tokyo (JP)

(72) Inventor: Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/481,658

(22) Filed: Sep. 9, 2014

(65) Prior Publication Data

US 2015/0070414 A1 Mar. 12, 2015

(30) Foreign Application Priority Data

Sep. 10, 2013 (JP) ..... 2013-187159

(51) Int. Cl.
*B41J 29/38* (2006.01)
*B41J 25/00* (2006.01)
*B41J 19/20* (2006.01)

(52) U.S. Cl.
CPC ..... *B41J 25/001* (2013.01); *B41J 19/202* (2013.01); *B41J 19/207* (2013.01)

(58) Field of Classification Search
CPC ..... B41J 2/0458; B41J 2/04541; B41J 11/22; B41J 25/3082
USPC ..... 347/5, 8
See application file for complete search history.

(56) References Cited

U.S. PATENT DOCUMENTS

| | | | | |
|---|---|---|---|---|
| 4,418,371 | A * | 11/1983 | Menden | 360/266.2 |
| 5,332,321 | A * | 7/1994 | Beauchamp et al. | 400/354 |
| 5,751,301 | A * | 5/1998 | Saikawa et al. | 347/8 |
| 2003/0043228 | A1 * | 3/2003 | Igarashi | 347/37 |
| 2013/0070023 | A1 * | 3/2013 | Ohashi et al. | 347/37 |

FOREIGN PATENT DOCUMENTS

JP 2010-089428 4/2010

* cited by examiner

*Primary Examiner* — Julian Huffman
*Assistant Examiner* — Sharon A Polk
(74) *Attorney, Agent, or Firm* — Workman Nydegger

(57) ABSTRACT

A recording apparatus includes a guiding shaft as a guiding portion that extends in a main scanning direction, a carriage, which is provided with a recording head that ejects ink, and which moves in the main scanning direction by sliding along the guiding shaft, and pressing units, which is provided in the carriage, and which presses the guiding shaft in a sub-scanning direction, and a sliding resistance is changed using the pressing units.

11 Claims, 10 Drawing Sheets

RECORDING APPARATUS

BACKGROUND

1. Technical Field

The present invention relates to a recording apparatus.

2. Related Art

In the related art, as an example of a recording apparatus, ink jet printers that perform recording on a recording medium such as a sheet by sliding a carriage that is provided with a recording head, which ejects ink, on a guiding shaft, is known. In this kind of ink jet printer, a so-called clearance, which is a space between the carriage and the guiding shaft, is provided and the carriage can smoothly slide along the guiding shaft.

FIG. 10 is a perspective view that shows a portion which is provided with ink cartridges 202 in a carriage 201 that moves along a guiding shaft 200 of the related art in a reciprocating manner in a main scanning direction D1. With the aim of miniaturizing recording apparatuses, there are ink jet printers in which the ink cartridges 202 are disposed so that a length L10 in a longitudinal direction becomes a sub-scanning direction D2, and the height of a vertical direction D3 is reduced.

If the length of the ink cartridges 202 in the sub-scanning direction D2 is made longer, a distance L11 from a center of gravity G of the ink cartridges 202 to the guiding shaft 200 becomes longer. Therefore, a moment M that inclines the carriage 201, in which the ink cartridges 202 are installed, with respect to the main scanning direction D1 becomes larger, and the carriage 201 becomes inclined with respect to the main scanning direction D1.

If ink is ejected from the recording head in a state in which the carriage 201 is inclined with respect to the main scanning direction D1, the quality of images that are recorded on the sheets is reduced. It is possible to consider reducing the size of the clearance as a countermeasure for reducing inclination of the carriage 201 with respect to the main scanning direction D1, but realization of such a countermeasure is difficult if the manufacturing error and assembly error of components is considered. In such an instance, there are ink jet printers that reduce an angle of inclination of a carriage with respect to an axial direction of a guiding shaft by providing load application means that bias a load against the guiding shaft. However, if the load application means are provided, sliding resistance in a movement direction of the carriage is increased.

In such an instance, in JP-A-2010-89428, a method that changes a load of load application means that bias with respect to a guiding shaft on the basis of a movement state of a carriage is suggested.

However, in the method of JP-A-2010-89428, it is necessary to provide a detection unit that detects the movement state of the carriage. In addition, an actuator that configures the load application means is configured by a small motor, an electromagnet and the like. Therefore, if means that change a load with respect to the guiding shaft are provided, electricity for the means is required. In addition, there is an increase in the size of the recording apparatus or the like, and therefore, there is a problem in that there is an increase in the manufacturing cost of the recording apparatus.

SUMMARY

The invention can be realized in the following forms or application examples.

APPLICATION EXAMPLE 1

A recording apparatus includes a carriage, which is provided with a recording head that ejects ink, and which moves in a first direction, a guiding portion that configures at least a portion of a movement range of the carriage, and along which the carriage slides, and a pressing unit, which is provided in the carriage, and which presses the guiding portion in a direction that intersects the first direction, in which a sliding resistance between the carriage and the guiding portion can be changed using the pressing units.

In this case, it is possible to change the sliding resistance between the carriage and the guiding portion using the pressing units. As a result of this, when the sliding resistance between the carriage and the guiding portion is reduced, it is possible to reduce the power consumption of the recording apparatus.

APPLICATION EXAMPLE 2

In the recording apparatus, a power source for operating the carriage may have an AC power source mode that is driven by an alternating power source, and a battery mode that is driven by a battery, and the sliding resistance may be reduced during the battery mode.

In this case, it is possible to make the power consumption during the battery mode less than the power consumption during the AC power source mode.

APPLICATION EXAMPLE 3

In the recording apparatus, the sliding resistance may be changed according to a movement speed of the carriage.

In this case, if the sliding resistance is set to be less when the movement speed of the carriage is fast, it is possible to reduce the power consumption of the recording apparatus.

APPLICATION EXAMPLE 4

In the recording apparatus, the sliding resistance may be changed in states in which a movement speed of the carriage is the same.

In this case, if the sliding resistance is set to be less, it is possible to reduce the power consumption of the recording apparatus.

APPLICATION EXAMPLE 5

The recording apparatus may further includes a carriage movement mechanism that moves the carriage, a sliding member that is provided in the carriage and moves in a sliding manner, a fixing unit that fixes a position of the sliding member in the first direction with respect to an apparatus main body, and a control unit that controls the carriage movement mechanism and the fixing unit, in which the control unit may change a pressing force depending on printing conditions.

In this case, it is possible to move the sliding member using a driving force in the movement direction of the carriage. Therefore, since it is not necessary to provide a movement mechanism for moving the sliding member separately, it is possible to suppress a circumstance in which there is an increase in the size of the recording apparatus or the like, and there is an increase in the manufacturing cost of the recording apparatus as a result.

APPLICATION EXAMPLE 6

In the recording apparatus, the pressing units may be provided with a sliding member that has cam portions and moves in the first direction in the carriage in a sliding manner, and a biasing member that generates a biasing force, and a pressing force may be changed depending on whether or not the biasing member is pushing the cam portions due to the position of the sliding member.

In this case, the pressing units are configured with a simple configuration. Therefore, it is possible to suppress a circumstance in which there is an increase in the size of the recording apparatus or the like, and there is an increase in the manufacturing cost of the recording apparatus as a result.

APPLICATION EXAMPLE 7

In the recording apparatus, a plurality of stepped portions with different heights may be provided in the cam portions of the sliding member in a direction that intersects the first direction.

In this case, the pressing force is changed depending on the plurality of positions to which the sliding member moves in a sliding manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described according to the drawings.

Embodiment 1

Figure 1:
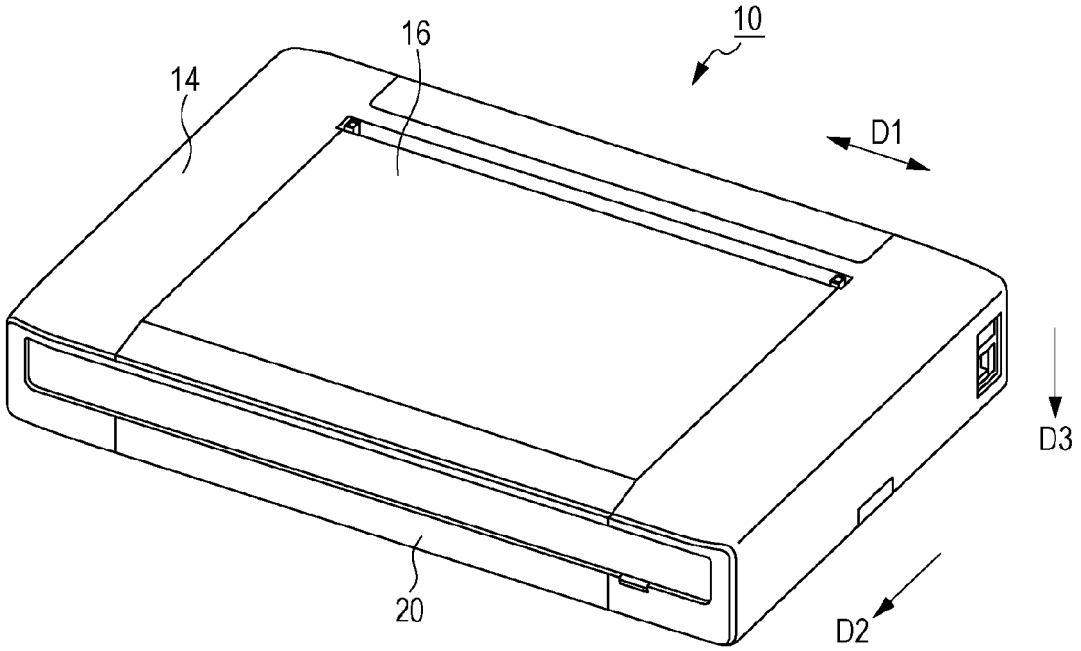
FIG. 1 is an external perspective view of an ink jet printer.
Figure 2:
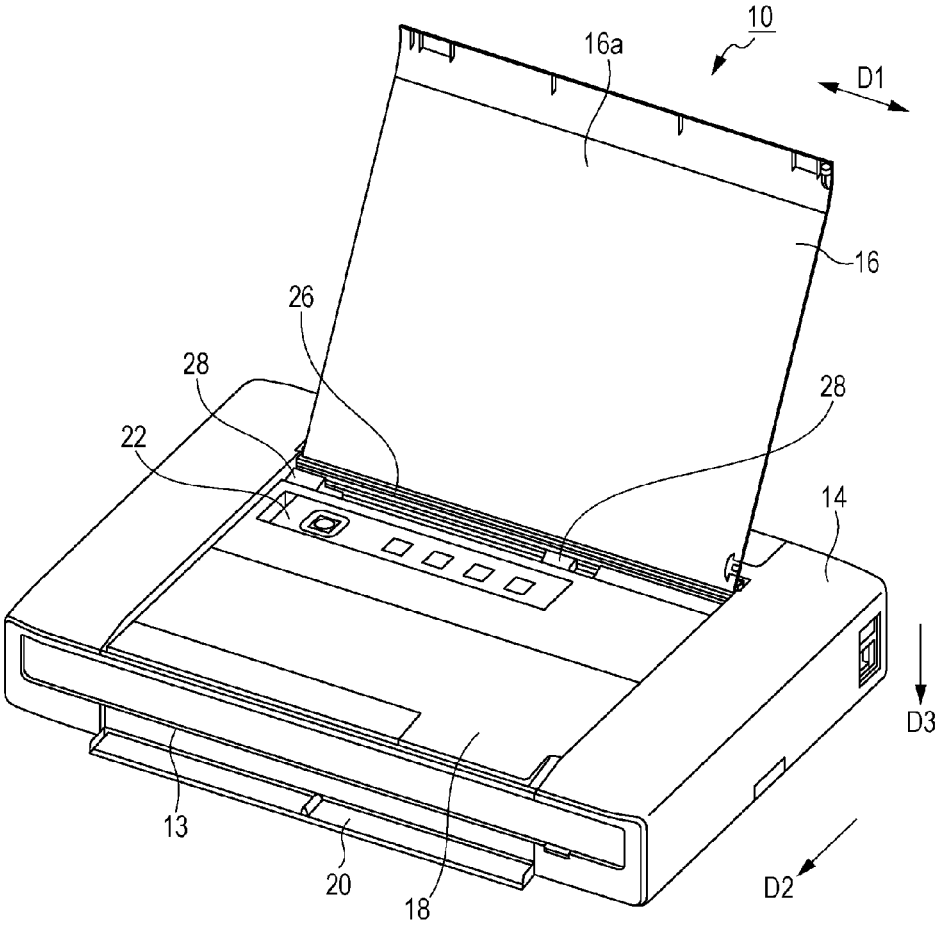
FIG. 2 is an external perspective view of an ink jet printer in a state in which a sheet supply portion cover is open.

FIG. 1 is an external perspective view of an ink jet printer (referred to as a printer below) 10, which is an example of a recording apparatus, and FIG. 2 is an external perspective view of the printer 10 in a state in which a sheet supply portion cover 16 is open. The overall configuration of the printer 10 will be described below.

A housing 14 covers an apparatus main body 12 (refer to FIG. 3) and configures the external appearance of the printer 10. A sheet supply portion cover 16 is provided on an upper surface of the printer 10 in a vertical direction D3. The sheet supply portion cover 16 is attached to an upper surface of the housing 14 in a rotatable manner. The sheet supply portion cover 16 can have the closed state of FIG. 1 and the open state of FIG. 2 with respect to the housing 14. In a case in which the sheet supply portion cover 16 is in a closed state with respect to the housing 14, the sheet supply portion cover 16 configures the upper surface of the housing 14 and the upper surface of the printer 10.

In the case of FIG. 2 in which the sheet supply portion cover 16 is in an open state with respect to the housing 14, the sheet supply portion cover 16 attains a state of being inclined on a back surface side (an upstream side of a sub-scanning direction D2) of the printer 10. In this state, a rear surface of the sheet supply portion cover 16 functions as mounting surface 16*a* of sheets as a recording medium.

A pair of sheet guides 28 that are configured to be capable of moving into contact with and away from one another are provided in a sheet aperture portion 26 in a width direction (a main scanning direction D1) of the printer 10. The pair of sheet guides 28 define positions of sheets in the width direction of the printer 10 by restricting both ends in the width direction of the sheets.

Figure 3:
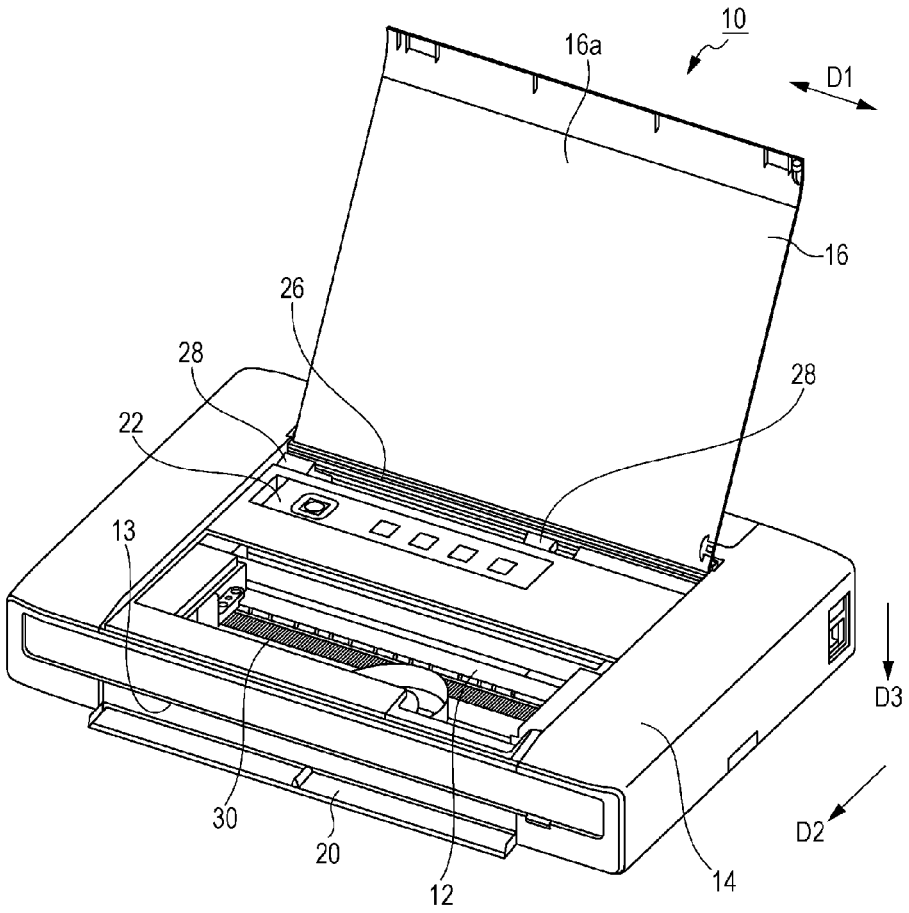
FIG. 3 is an external perspective view of an ink jet printer in a state in which a recording unit protective cover has been removed from a housing.

FIG. 3 is an external perspective view of the printer 10 in a state in which a recording unit protective cover 18 has been removed from the housing 14. As shown in FIG. 3, in a case of a state in which the recording unit protective cover 18 of FIG. 2 has been removed from the housing 14, it is possible for a user to access a recording unit 30 that is provided in the apparatus main body 12.

An operation unit 22 is configured to be provided with a power source button, printer settings buttons and the like for operating the printer 10. In a case in which the sheet supply portion cover 16 is in an open state with respect to the housing 14, it is possible for a user to access the operation unit 22, and therefore, operation of the printer 10 is possible.

A discharge portion cover 20 is provided on a front surface (a downstream side of the sub-scanning direction D2) of the housing 14 in a rotatable manner. As shown in FIG. 2, in a state in which the discharge portion cover 20 is open, an aperture portion for discharge 13 is formed on the front surface of the housing 14.

Figure 4:
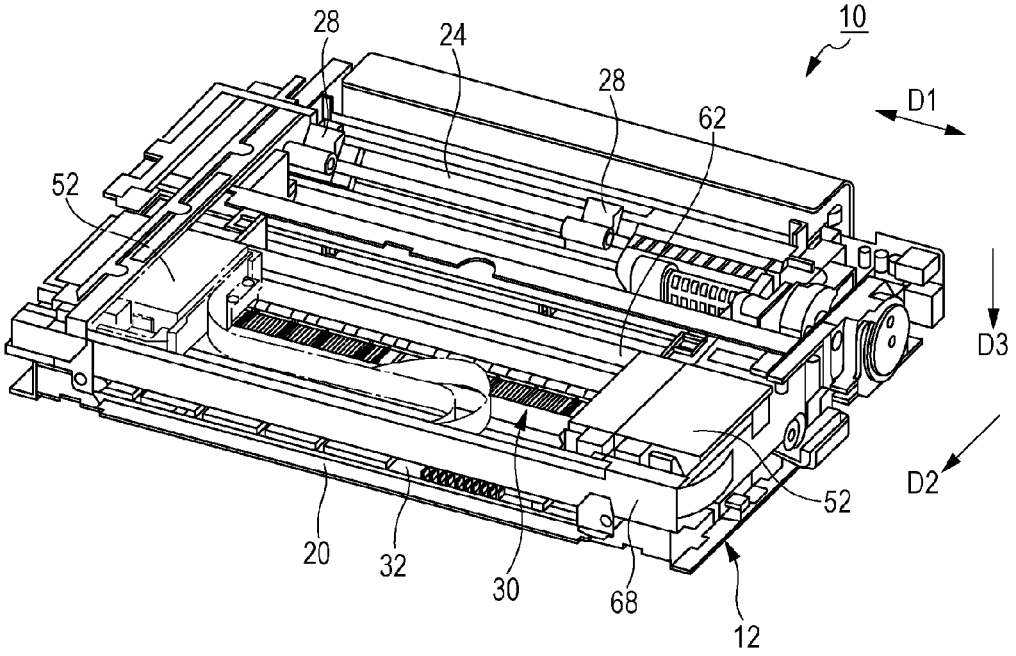
FIG. 4 is a perspective view of an apparatus main body in a state in which the housing, the sheet supply portion cover and the recording unit protective cover have been taken out.
Figure 5:
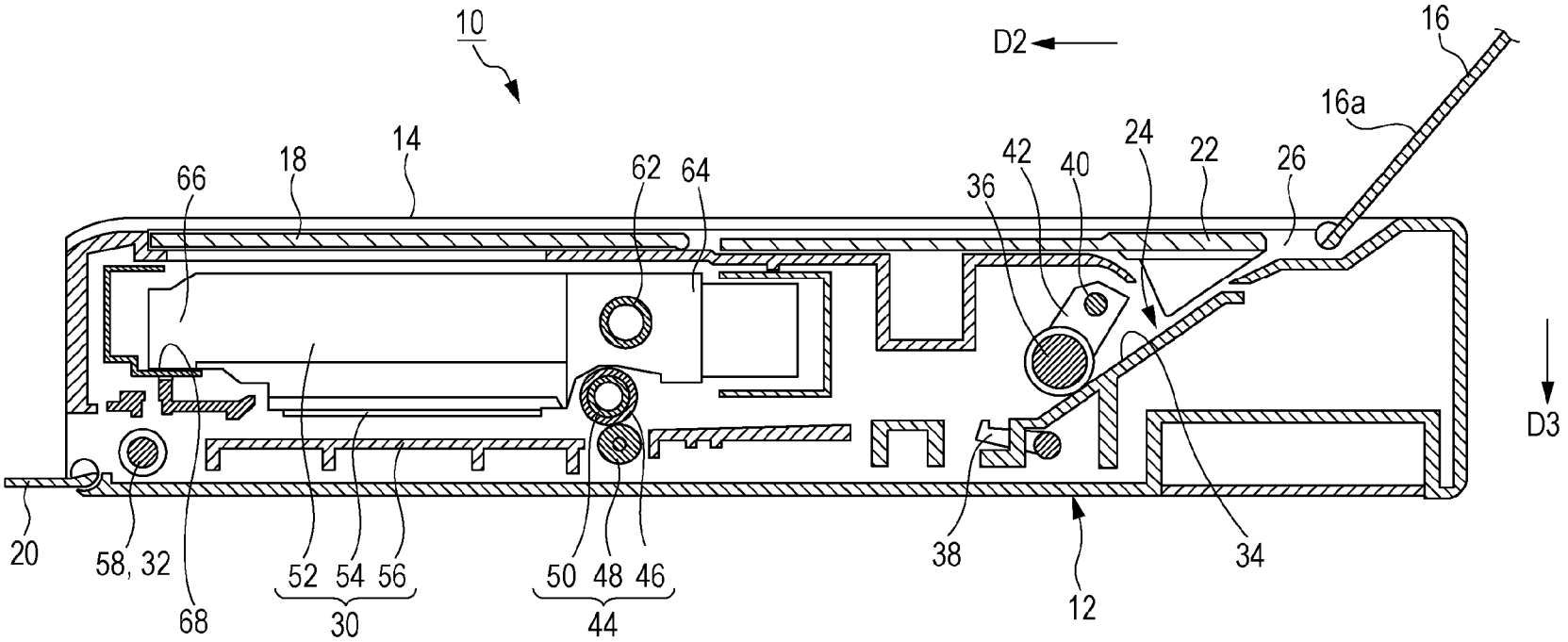
FIG. 5 is a cross-sectional view of the ink jet printer.

FIG. 4 is a perspective view of an apparatus main body 12 in a state in which the housing 14, the sheet supply portion cover 16 and the recording unit protective cover 18 have been taken out. FIG. 5 is a cross-sectional view of the printer 10 viewed from the main scanning direction D1.

A sheet supply portion 24 that feeds sheets that are mounted on the mounting surface 16*a* (refer to FIG. 2) to a downstream side in the sub-scanning direction D2, is provided. Hereinafter, "upstream side" and "downstream side" refer to the upstream side and the downstream side in the sub-scanning direction D2. The sheet supply portion 24 is provided with the sheet aperture portion 26, the pair of sheet guides 28 that is provided in the sheet aperture portion 26, a sheet guide inner surface 34 that guides sheets that are inserted from the sheet aperture portion 26, a pick-up roller 36 that is provided in a position that faces the sheet guide inner surface 34, and a return lever 38.

In the case of FIG. 2 in which the sheet supply portion cover 16 is in an open state with respect to the housing 14, the sheet aperture portion 26 attains an open state with respect to the top of the printer 10. Therefore, in the sheet supply portion 24 of FIG. 4, it is possible to feed sheets that are mounted on the mounting surface 16*a* into a feeding pathway (to be described later).

The pick-up roller 36 of FIG. 5 is provided on a supporting member 42 that swings with a swinging shaft 40 as the center thereof. The pick-up roller 36 is configured to be capable of swinging in a direction that moves into contact with and away from the sheets that are mounted on the sheet guide inner surface 34. The pick-up roller 36 comes into contact with the topmost sheet that is mounted on the sheet guide inner surface 34 and feeds the topmost sheet to the downstream side when displaced in a direction that comes into contact with the sheet guide inner surface 34. At this time, the sheets in the next position and after are returned to the sheet guide inner surface 34 by the return lever 38, and a circumstance in which the sheets in the next position and after are carelessly fed to the downstream side is prevented.

A transport unit 44 is provided on the downstream side of the sheet supply portion 24. The transport unit 44 is provided with a transport driving roller 46 and a transport driven roller 48. The transport driving roller 46 is integrally attached to a transport roller shaft 50, and rotates with the transport roller shaft 50 as a result of a driving means that is not shown in the drawings. The transport unit 44 transports sheets that are fed from the sheet supply portion 24 to a downstream side by nipping the sheets between the transport driving roller 46 and the transport driven roller 48. The recording unit 30 is provided on the downstream side of the transport unit 44.

The recording unit 30 is provided with a carriage 52, a recording head 54 that is provided on the bottom surface of the carriage 52, and a lower portion guiding member, that is, a platen 56 as a supporting portion that faces the recording head 54 and supports the sheets. The recording head 54 faces sheets that are supported by the platen 56.

The carriage 52 reciprocates in a main scanning direction D1 due to a movement mechanism of the carriage. The platen 56 defines a distance (a gap) between a recording surface of the sheets and a head surface of the recording head 54 by supporting the sheets from beneath.

A discharge portion 32 is provided on the downstream side of the recording unit 30. The discharge portion 32 is provided with a discharge roller 58. Sheets on which recording has been executed by the recording unit 30 are discharged toward the downstream side in the transport direction (the downstream side in the sub-scanning direction D2) of the discharge portion 32, that is, toward the front of the apparatus by the discharge roller 58.

In addition to the carriage 52, the recording head 54, and the platen 56, the recording unit 30 is further provided with a guiding shaft 62 and a movement mechanism of the carriage. The guiding shaft 62 is provided in manner that extends in the main scanning direction D1, that is, the width direction of the apparatus main body. The guiding shaft 62 supports the carriage 52 by passing through a shaft receiving portion 64 that is provided on the back surface side of the carriage 52. In addition, the guiding shaft 62 is configured as a hollow shaft.

The carriage 52 is provided with a supporting portion 66 on the front surface side of the carriage 52. The carriage 52 is supported by a frame 68 that is provided in the apparatus main body 12 through the supporting portion 66 and that extends in the main scanning direction D1.

Figure 6:
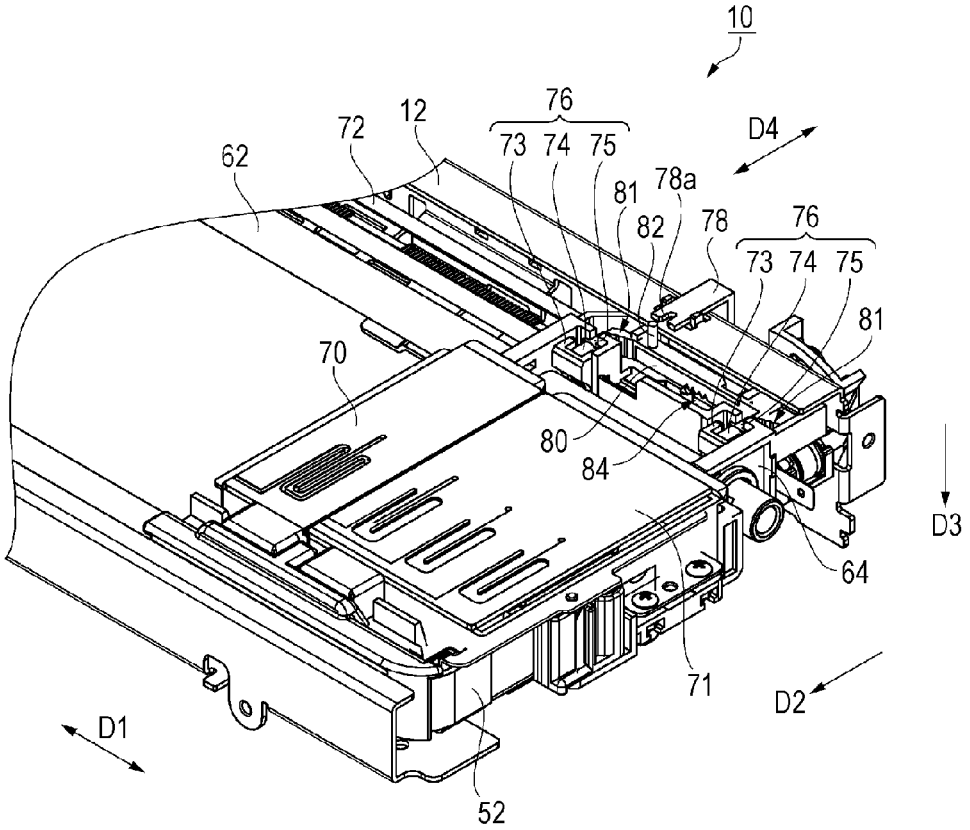
FIG. 6 is a perspective view of a portion of a carriage that is supported by a guiding shaft.

FIG. 6 is a perspective view of a portion of the carriage 52 that is supported by the guiding shaft 62. A monochromatic ink cartridge 70 in which monochromatic ink is accommodated, and color ink cartridges 71 in which the respective ink colors of yellow, magenta and cyan are accommodated are installed in the carriage 52.

In a state in which the monochromatic ink cartridge 70 and the color ink cartridges 71 are mounted in the carriage 52, the monochromatic ink cartridge 70 and the color ink cartridges 71 are positioned so that the longer sides thereof extend in the sub-scanning direction D2. As a result of this, since it is possible to reduce the height of the vertical direction D3, it is possible to reduce the size of the printer 10.

An endless belt 72 is driven in a rotating manner by a carriage motor (not shown in the drawings). The carriage 52 is connected to the endless belt 72, and the carriage 52 reciprocates in the main scanning direction D1 according to the rotational driving of the endless belt 72.

A pair of pressing units 76 that are lined up in the main scanning direction D1 are provided on sides of the shaft receiving portion 64 in the carriage 52. The pressing units 76 are configured by a first pressing member 73, a coil-shaped spring member 74, which is a biasing member, and a second pressing member 75 which are arranged lined up in the sub-scanning direction D2. The coil-shaped spring members 74 are provided between the first pressing members 73 and the second pressing members 75.

The first pressing members 73 are provided so as to capable of sliding in the sub-scanning direction D2, downstream sides thereof abut against the guiding shaft 62, and upstream sides thereof abut against the coil-shaped spring members 74. The second pressing members 75 are provided so as to capable of sliding in the sub-scanning direction D2, downstream sides thereof abut against the coil-shaped spring members 74, and upstream sides thereof abut against a sliding member 80.

The sliding member 80 is provided on a back surface side of the carriage 52, and is provided so as to be capable of sliding in the main scanning direction D1. A pair of cam portions 81 that are arranged lined up in the main scanning direction D1 are formed on the sliding member 80. In addition, a pin 82 that protrudes on an upper side is formed on the sliding member 80.

A lever 78 that is capable of moving in an arrow direction D4 in the sub-scanning direction D2 is provided in the apparatus main body 12. The lever 78 is capable of moving to positions on the upstream side and the downstream side due to an actuator (not shown in the drawings) that is operated by a motor and an electromagnetic valve.

Figure 7:
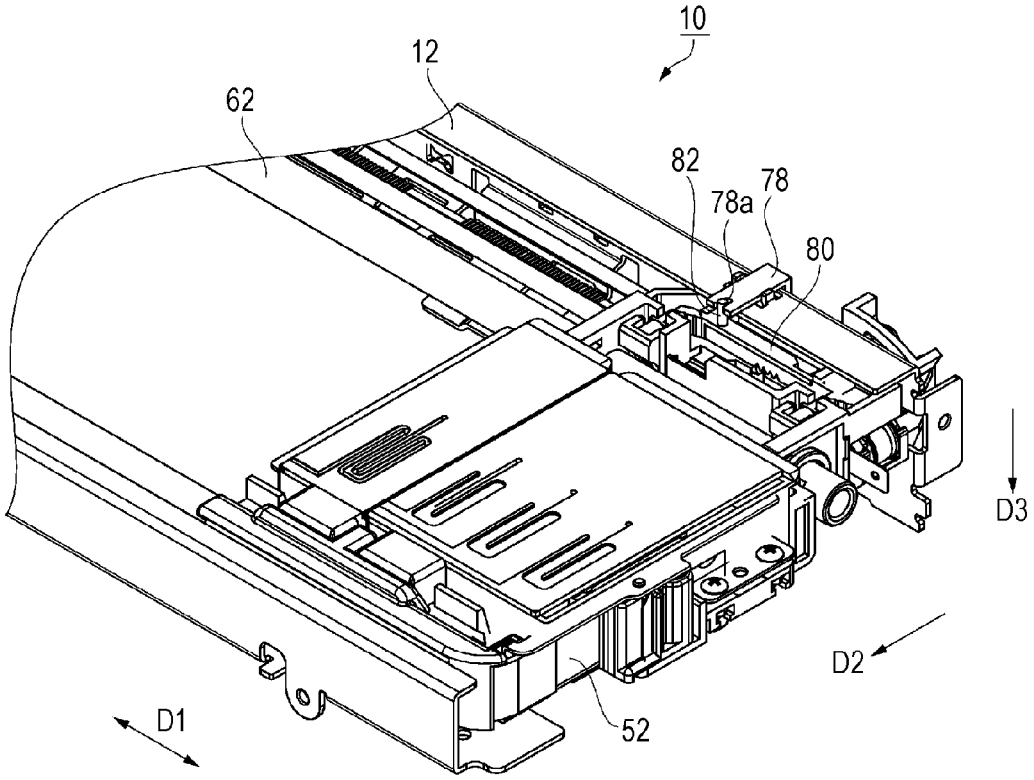
FIG. 7 is perspective view of a portion of the carriage that is supported by the guiding shaft.

The lever 78 in FIG. 6 in a position on an upstream side, and a non-engagement state of a concave portion 78*a* that is formed on the downstream side of the lever 78 and the pin 82, is shown. FIG. 7 is perspective view of a portion of the carriage 52 that is supported by the guiding shaft 62, and shows a state in which the lever 78 is in a position on the downstream side, and the concave portion 78*a* of the lever 78 and the pin 82 are engaged.

Figure 8A:
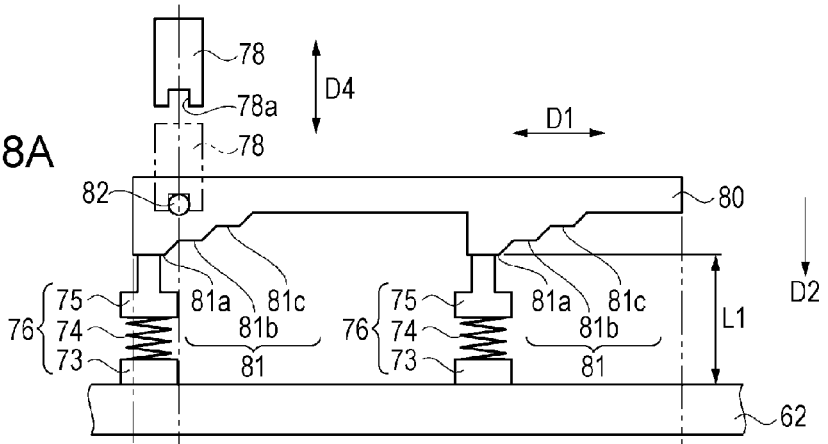
FIGS. 8A and 8B are views that show a relative positional relationship between a sliding member and pressing units.
Figure 8B:
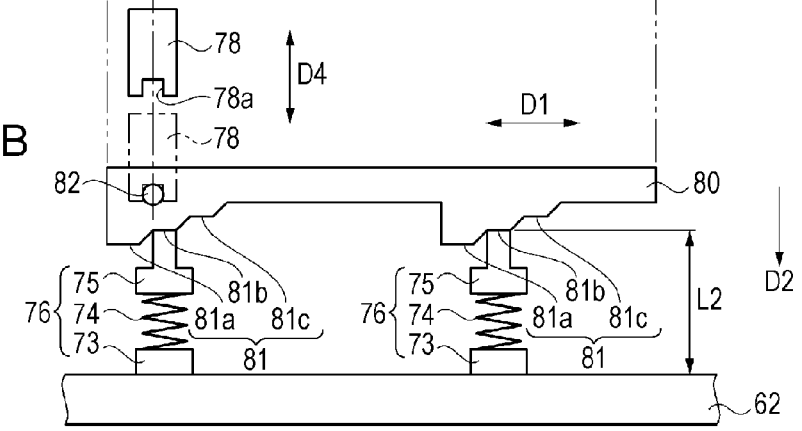

FIGS. 8A and 8B are viewed from the upper side of the vertical direction D3 and are views that show a positional relationship between a sliding member 80 and pressing units 76 in the main scanning direction D1. As described above, when the lever 78 that is shown by a broken line is in a position on the downstream side (refer to FIG. 7), the concave portion 78*a* of the lever 78 can be engaged with the pin 82 of the sliding member 80. When the lever 78 that is shown by a solid line is in a position on the upstream side (refer to FIG. 6), the concave portion 78*a* is in a non-engagement position with the pin 82.

Stepped portions 81*a*, 81*b* and 81*c*, which have different heights in the sub-scanning direction D2, are respectively provided in the pair cam portions 81 of the sliding member 80.

FIG. 8A is a view that shows a state in which the pair of second pressing members 75 are in positions that respectively abut against the stepped portions 81*a*. The pair of first pressing members 73 respectively abut against the guiding shaft 62. As a result of a biasing force of the coil-shaped spring members 74, the first pressing members 73 press the guiding shaft 62 to the downstream side, and the second pressing members 75 press the sliding member 80 to the upstream side.

As shown by a dashed-dotted line, the lever 78 is in a position in which the position thereof in the main scanning direction D1 is fixed with respect to the apparatus main body 12. As described above, the sliding member 80 is provided to be capable of moving in a sliding manner with respect to the carriage 52. Therefore, even if the carriage 52 moves to a right side in the main scanning direction D1 in the drawing in a state in which the concave portion 78*a* is engaged with the pin 82, as shown by a double dashed-dotted line, the position of the sliding member 80 in the main scanning direction D1 is fixed.

If the carriage 52 is moved to the right side in the drawing in a state in which the lever 78 that is in the state of FIG. 8A is in a position on the downstream side that is shown by the broken line and engaged with the pin 82, the pressing units 76 that are provided in the carriage 52 also move to the right side in the drawing along the stepped portions of the sliding member 80, and as shown in FIG. 8B, the pair of second pressing members 75 reach a position of respectively abutting against the stepped portions 81*b*.

The pair of first pressing members 73 of FIG. 8B respectively abut against the guiding shaft 62. As a result of a biasing force of the coil-shaped spring members 74, the first pressing members 73 press the guiding shaft 62 to the downstream side, and the second pressing members 75 press the sliding member 80 to the upstream side.

The position of the stepped portions 81*b* is on the upstream side of the position of the stepped portions 81*a*. Therefore, a distance L2 between the stepped portions 81*b* and the guiding shaft 62 in FIG. 8B is longer than a distance L1 between the stepped portions 81*a* and the guiding shaft 62 in FIG. 8A. Therefore, the biasing force due to the pressing units 76 that pushes the guiding shaft 62 is less when the second pressing members 75 are in the positions of FIG. 8B of abutting against the stepped portions 81*b* than when the second pressing members 75 are in the positions of FIG. 8A of abutting against the stepped portions 81*a*.

Therefore, a sliding resistance when the carriage 52 slides with the guiding shaft 62 is less when the second pressing members 75 are in the positions of FIG. 8B of abutting against the stepped portions 81*b* than when the second pressing members 75 are in the positions of FIG. 8A of abutting against the stepped portions 81*a*.

The stepped portions 81*c* are positioned further on the upstream side than the stepped portions 81*b*. Therefore, a sliding resistance when the carriage 52 slides with the guiding shaft 62 is even less when the second pressing members 75 are in the positions of abutting against the stepped portions 81*c* than when the second pressing members 75 are in the positions of FIG. 8B of abutting against the stepped portions 81*b*.

Figure 8C:
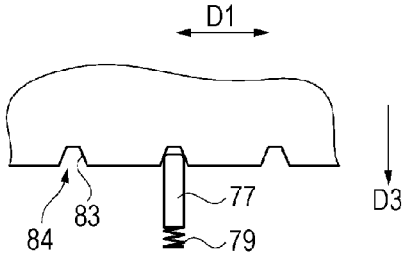
FIG. 8C is an enlarged view of a portion of a notched portion in the sliding member.

FIG. 8C is viewed from the sub-scanning direction D2 and is an enlarged view of a portion of a notched portion 84 that is formed on a lower side of the sliding member 80. The notched portion 84 in which a plurality of substantially V-shaped concave portions 83 are arranged lined up in the main scanning direction D1 (refer to FIG. 6) is formed on a lower side of the sliding member 80. A protruding portion 77 that protrudes on an upper side is provided in the carriage 52. The protruding portion 77 is biased toward an upper side with respect to the sliding member 80 by a biasing member 79 such as a coil-shaped spring.

If the carriage 52 is moved in the main scanning direction D1 when the concave portion 78*a* of the lever 78 is engaged with the pin 82 with the lever 78 in the position on the downstream side and the position of the lever 78 with respect to the apparatus main body 12 is fixed, it is possible to shift the protruding portion 77 from a concave portion 83, and engage the protruding portion 77 with an adjacent concave portion 83 by moving the protruding portion 77 along a lower surface of the sliding member 80.

As a result of this configuration, when the concave portion 78*a* of the lever 78 is engaged with the pin 82 with the lever 78 in the position on the upstream side, and the carriage 52 reciprocates in the main scanning direction D1, the protruding portion 77 engages in a state of pushing a single concave portions 83, and the position in the main scanning direction D1 of the sliding member 80 in the carriage 52 is fixed.

That is, a state in which the second pressing members 75 press the stepped portions 81*a* (81*b*, 81*c*) is secured by the protruding portion 77 and the notched portion 84, and the carriage 52 reciprocates in the main scanning direction D1.

A fixing unit in the present embodiment is configured by an actuator and the lever 78. The fixing unit fixes the position of the sliding member 80 in the main scanning direction D1 with respect to the apparatus main body 12.

Figure 9:
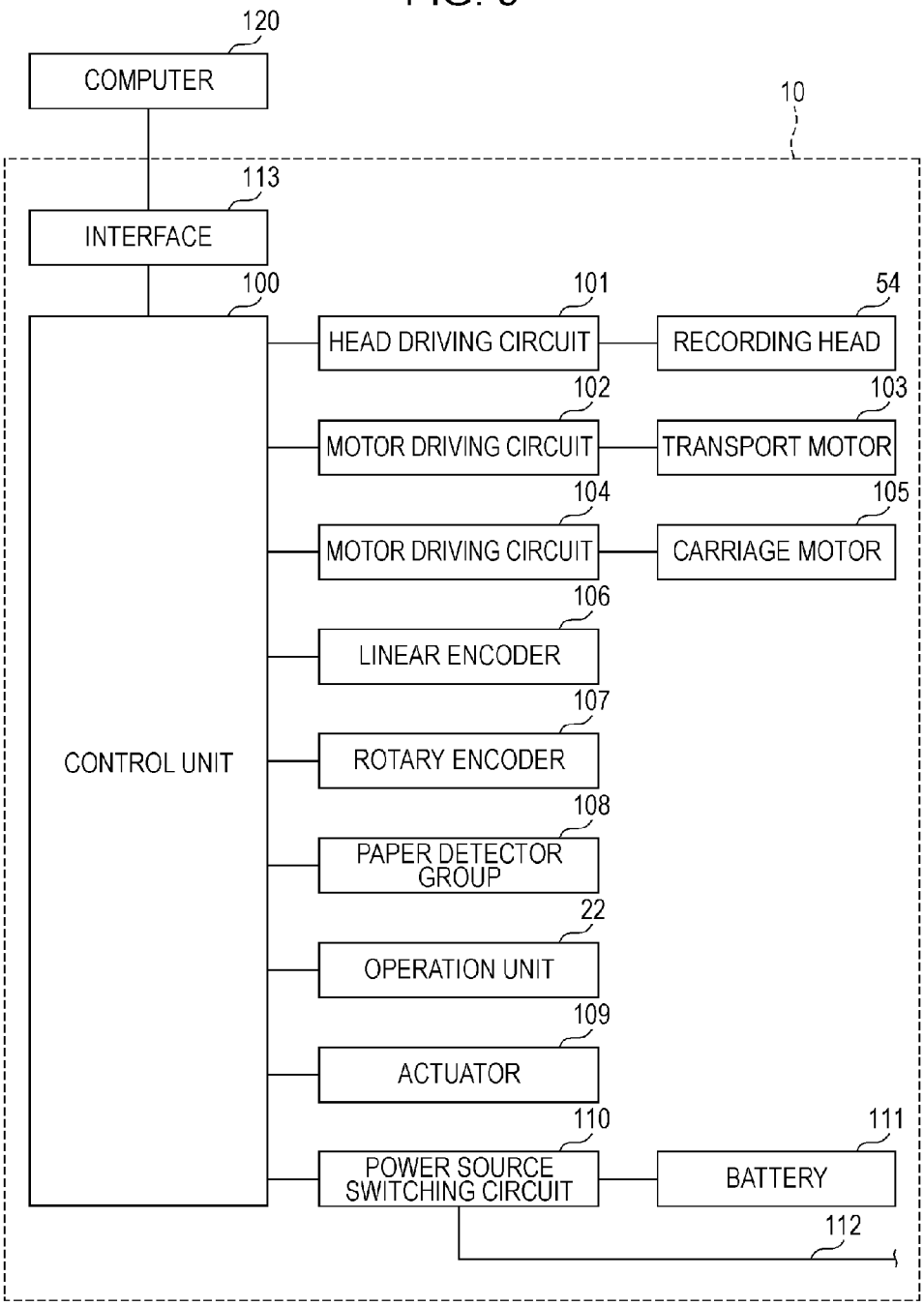
FIG. 9 is a block configuration diagram that shows an electrical schematic configuration.
Figure 10:
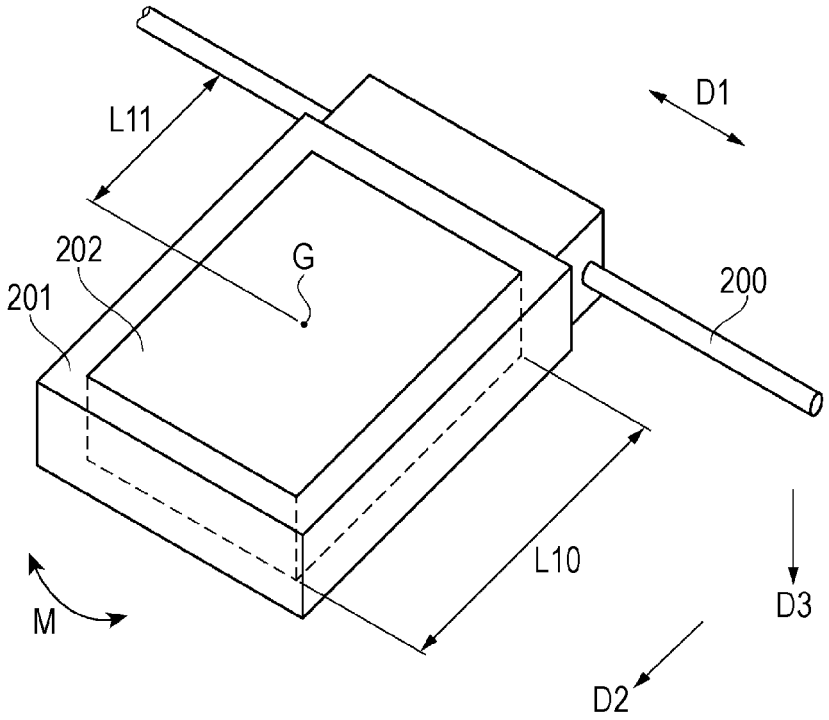
FIG. 10 is a perspective view that shows a portion in which ink cartridges are provided in a carriage of the related art that moves in a reciprocating manner along a guiding shaft.

FIG. 9 is a block configuration diagram that shows an electrical schematic configuration. Printing data that is sent from a computer 120 that is disposed outside the printer 10 is received in a control unit 100 via an interface 113. Control commands such as image data of a printing target and printing conditions are included in the printing data.

The control unit 100 develops print data in units of dots for forming images by ejecting ink from the recording head 54 on the basis of received image data and printing conditions. A head driving circuit 101 executes discharge control of ink from the recording head 54 according to the instructions of the control unit 100.

A motor driving circuit 102 drives a transport motor 103 in a rotational manner according to the instructions of the control unit 100, and the pick-up roller 36 in FIG. 5, and the transport driving roller 46 are driven in a rotational manner using a transmission mechanism such as gears (not shown in the drawings). A motor driving circuit 104 drives a carriage motor 105 in a rotational manner according to the instructions of the control unit 100, and the carriage 52 that is fixed to the endless belt 72 in FIG. 6 reciprocates.

A linear encoder 106 is an optical detector, and the control unit 100 detects the position of the carriage 52 in the main scanning direction D1 using the linear encoder 106. A rotary encoder 107 is an optical detector, and the control unit 100 detects an amount of rotation of the transport motor 103 using the rotary encoder 107.

A paper detector group 108 is configured by a sheet end portion detector that detects the positions of end portions of sheets that are transported by the rotatable lever, an optical sheet width detector that is provided in the carriage 52 and detects the width of sheets in the main scanning direction D1 and the like. The control unit 100 executes printing operations such as the setting of printing conditions, the switching on and off of a power source and the like on the basis of input information from a user using the operation unit 22 (refer to FIG. 2).

An actuator 109 can set the lever 78 in FIG. 6 to a position on the upstream side or the downstream side according to the instructions of the control unit 100.

The printer 10 can drive using an AC power source 112 or a battery 111. A power source switching circuit 110 is a circuit that switches the power source that drives the printer 10 between the AC power source 112 and the battery 111. The control unit 100 can detect whether the printer 10 is in an AC power source mode that is driven by the AC power source 112 or in a battery mode that is driven by the battery 111.

A case in which the control unit 100 detects that the printer 10 is in the AC power source mode will be described.

The control unit 100 moves the carriage 52 in the main scanning direction D1 so that the pin 82 of the carriage 52 reaches a position of the concave portion 78*a* of the lever 78, and engages the lever 78 with the pin 82 at the downstream side position using the actuator 109. As a result of this, the position of the sliding member 80 in the main scanning direction D1 with respect to the apparatus main body 12 enters a fixed state.

Next, the control unit 100 moves the carriage 52 so that the second pressing members 75 in FIG. 8A reach a position that abuts against the stepped portions 81*a* of the cam portions 81. Further, the control unit 100 causes the lever 78 to evade a non-engagement position with the pin 82 at the upstream side position using the actuator 109, and executes a printing operation by reciprocating the carriage 52.

When the printer 10 is driven by the AC power source, printing is executed by reciprocating the carriage 52 in a state in which the second pressing members 75 push the stepped portions 81*a* of the cam portions 81.

Next, a case in which the control unit 100 detects that the printer 10 is in the battery mode will be described. The control unit 100 moves the carriage 52 in the main scanning direction D1 so that the pin 82 of the carriage 52 reaches a position of the concave portion 78*a* of the lever 78, and engages the lever 78 with the pin 82 at the downstream side position using the actuator 109. As a result of this, the position of the sliding member 80 in the main scanning direction D1 with respect to the apparatus main body 12 enters a fixed state.

The control unit 100 moves the carriage 52 so that the second pressing members 75 in FIG. 8B reach a position that abuts against the stepped portions 81*b* of the cam portions 81. Further, the control unit 100 causes the lever 78 to evade a non-engagement position with the pin 82 at the upstream side position using the actuator 109, and executes a printing operation by reciprocating the carriage 52.

When the printer 10 is driven by the battery mode, the carriage 52 may be moved so that the second pressing members 75 reach a position that abuts against the stepped portions 81*c* of the cam portions 81.

When the printer 10 is driven by the battery, printing is executed by reciprocating the carriage 52 in a state in which the second pressing members 75 push the stepped portions 81*b* (81*c*) of the cam portions 81.

As a result of this kind of configuration, when the printer 10 is driven by the battery, it is possible to reduce the sliding resistance when the carriage 52 slides along the guiding shaft 62 by driving using the AC power source. As a result of this, it is possible to reduce the power consumption when the printer 10 is driven by the battery 111.

A carriage movement mechanism of the present embodiment is configured to include the carriage motor 105, the endless belt 72 and a pair of roller (not shown in the drawings) that support the endless belt 72 in a rotatable manner.

In the present embodiment, the sliding resistance was changed using movement control of the lever 78 due to the actuator 109 and movement control of the carriage 52, but a method that changes the sliding resistance according to the manual operation of a user may also be used. More specifically, a configuration in which a user changes the position of the pressing units 76 with respect to the cam portions 81 by moving the sliding member 80 with respect to the carriage 52 in a sliding manner by manual operation, may be used.

The printer 10 that is described above by the present embodiment is provided with a guiding shaft 62 as a guiding portion that extends in the main scanning direction D1, which is a first direction, a carriage 52 that moves in the main scanning direction D1 by sliding on the guiding shaft 62 and has the recording head 54 that ejects ink, and pressing units 76, which are provided in the carriage 52, and which press the guiding shaft 62 in the sub-scanning direction D2 that intersects the main scanning direction D1, and the sliding resistance between the carriage 52 and the guiding shaft 62 can be changed using the pressing units 76.

According to this configuration, when the sliding resistance between the carriage 52 and the guiding shaft 62 is reduced, it is possible to reduce the power consumption of the printer 10.

In the present embodiment, the three stepped portions 81*a*, 81*b* and 81*c* are provided in cam portions 81, and printing was executed in a state of abutting against any one of the stepped portions, but a configuration in which a single stepped portion is provided in each cam portion 81, and the pressing force thereof is changed depending on whether or not the coil-shaped spring members 74 are pushing the cam portions 81 due to the position of the sliding member 80, may be used.

According to this configuration, the pressing units 76 is configured by a simple configuration. Therefore, it is possible to suppress a circumstance in which there is an increase in the size of the printer 10, and there is an increase in the manufacturing cost of the printer 10 as a result.

In addition, the plurality of stepped portions 81*a*, 81*b* and 81*c*, the heights in the sub-scanning direction D2 of which differ, are provided in the cam portions 81 of the sliding member 80. According to this configuration, the pressing force can be changed depending on a plurality of positions of the sliding member 80.

In addition, the printer 10 is provided with the carriage movement mechanism that moves the carriage 52, the sliding member 80 that is provided in the carriage 52 and moves in a sliding manner, the lever 78 as a fixing unit that fixes the position of the sliding member 80 with respect to the apparatus main body 12, and the control unit 100 that controls the carriage movement mechanism and the lever 78, and the control unit 100 moves the sliding member 80 by moving the carriage 52 using the carriage movement mechanism in a state in which the lever 78 fixes the position of the sliding member 80 with respect to the apparatus main body 12.

According to this configuration, it is possible to move the sliding member 80 using the driving force in the movement direction of the carriage 52. Therefore, since it is not necessary to provide a movement mechanism for moving the sliding member 80 separately, it is possible to suppress a circumstance in which there is an increase in the size of the printer 10 or the like, and there is an increase in the manufacturing cost of the printer 10 as a result.

In addition, a power source for driving the carriage movement mechanism that moves the carriage 52 and the lever 78 has an AC power source mode that is driven by an AC power source, and a battery mode that is driven by a battery, and the control unit 100 controls the lever 78 so that the pressing force during the battery mode is less than the pressing force during the AC power source mode.

According to this configuration, the sliding resistance of the carriage 52 during the battery mode is less than the sliding resistance of the carriage 52 during the AC power source mode. Therefore, it is possible to make the power consumption during the battery mode less than the power consumption during the AC power source mode.

Furthermore, in a case of driving with the battery mode, it is possible to increase the number of sheets that can be printed.

Embodiment 2

In Embodiment 1, a recording apparatus in which the pressing force of the pressing units 76 is changed depending on the battery mode or the AC power source mode was described, but in Embodiment 2, a recording apparatus in which the pressing force of the pressing units 76 is changed depending on a movement speed of the carriage 52 will be described.

The control unit 100 receives printing data from the computer 120 via the interface 113. Control commands such as image data of a printing target and printing conditions are included in the printing data. The control unit 100 changes the pressing force of the pressing units 76 depending on the movement speed of the carriage 52.

For example, the pressing force of the pressing units 76 is changed depending on a draft mode or a normal mode. The movement speed of the carriage 52 in the draft mode is faster than the movement speed of the carriage 52 in the normal mode. The control unit 100 controls a movement operation of the lever 78 and a movement operation of the carriage 52 so that the second pressing members 75 in FIG. 8B reach a position that abuts against the stepped portions 81*b* or the stepped portions 81*c* when a resolution in the printing conditions is in a draft mode.

The control unit 100 controls a movement operation of the lever 78 and a movement operation of the carriage 52 so that the second pressing members 75 in FIG. 8A reach a position that abuts against the stepped portions 81*a* when a resolution in the printing conditions is in a normal mode.

If such a configuration is used, the pressing force of the pressing units 76 is less in a draft mode than in a normal mode. Therefore, the sliding resistance between the carriage 52 and the guiding shaft 62 of the draft mode is less than the normal mode. As a result of this, the power consumption in the draft mode is less than the normal mode.

Additionally, by reducing the sliding resistance, the inclination of the carriage 52 with respect to the main scanning direction D1 changes with reciprocation of the carriage 52, but this does not have a significant effect on printing quality.

In addition, a configuration in which the control unit 100 sets the movement speed of the carriage 52 as the same, and changes the pressing force of the pressing units 76 depending on differences in the printing conditions due to sheet types, may also be used.

For example, the control unit 100 controls a movement operation of the lever 78 and a movement operation of the carriage 52 so that the second pressing members 75 in FIG. 8B reach a position that abuts against the stepped portions 81*b* or the stepped portions 81*c* when the printing conditions due to sheet type are "normal sheets".

The control unit 100 controls a movement operation of the lever 78 and a movement operation of the carriage 52 so that the second pressing members 75 in FIG. 8A reach a position that abuts against the stepped portions 81*a* when the printing conditions due to sheet type are "glossy paper".

If such a configuration is used, the pressing force of the pressing units 76 is less for "normal sheets" than for "glossy paper". As a result of this, since the sliding resistance between the carriage 52 and the guiding shaft 62 of "normal sheets" is less than that of "glossy paper", it is possible to reduce the power consumption thereof.

Additionally, by reducing the sliding resistance, the inclination of the carriage 52 with respect to the main scanning direction D1 changes with reciprocation of the carriage 52, but this does not have a significant effect on printing quality.

Other configurations of Embodiment 2 are the same as the configurations of Embodiment 1. In Embodiment 1 and Embodiment 2, the guiding portion was configured by a cylindrical guiding shaft 62, but a rail-shaped guiding portion that is provided to extend in the main scanning direction D1 is also possible.

The entire disclosure of Japanese Patent Application No. 2013-187159, filed Sep. 10, 2013 is expressly incorporated by reference herein

What is claimed is:

1. A recording apparatus comprising:

a carriage, which is provided with a recording head that ejects ink, and which moves in a first direction;

a guiding portion that configures at least a portion of a perimeter of a movement range of the carriage, and along which the carriage slides;

a sliding member, that is provided in the carriage and moves in a sliding manner, a pressing unit, which is provided in the carriage, and which presses the guiding portion in a direction that intersects the first direction; and a power source for operating the carriage having an AC power source mode that is driven by an alternating power source, and a battery mode that is driven by a battery, wherein a sliding resistance between the carriage and the guiding portion is changed by varying a distance between where the pressing unit contacts the sliding member and presses the guiding portion based on the power source.

2. The recording apparatus according to claim 1, wherein the sliding resistance is reduced during the battery mode by making the distance between where the pressing unit contacts the sliding member and presses the guiding portion larger during the battery mode than the distance between where the pressing unit contacts the sliding member and presses the guiding portion during the AC power source mode.

3. The recording apparatus according to claim 1, wherein the sliding resistance is changed according to a movement speed of the carriage by making the distance between where the pressing unit contacts the sliding member and presses the guiding portion larger at a second carriage speed than the distance between where the pressing unit contacts the sliding member and presses the guiding portion at a first carriage speed.

4. The recording apparatus according to claim 1, wherein the sliding resistance is changed according to a type of print medium on which the ink is ejected by making the distance between where the pressing unit contacts the sliding member and presses the guiding portion larger for a second print medium type than the distance between where the pressing unit contacts the sliding members and presses the guiding portion for a first print medium type.

5. The recording apparatus according to claim 1, wherein the pressing unit is provided with a biasing member that generates a biasing force, and wherein the sliding member has cam portion that contact the pressing unit, wherein a force generated by the pressing unit contacting the guiding portion is changed depending on whether or not the biasing member is pushing the cam portions due to a position of the sliding member.

6. The recording apparatus according to claim 5, wherein a plurality of stepped portions with different heights are provided in the cam portions of the sliding member in a direction that intersects the first direction.

7. A recording apparatus comprising:

a carriage, which is provided with a recording head that ejects ink, and which moves in a first direction;

a guiding portion that configures at least a portion of a perimeter of a movement range of the carriage, and along which the carriage slides;

a pressing unit, which is provided in the carriage, and which presses the guiding portion in a direction that intersects the first direction;

a sliding member that is provided in the carriage and moves in a sliding manner;

a fixing unit that fixes a position of the sliding member in the first direction with respect to an apparatus main body; and a control unit that controls a carriage movement mechanism and the fixing unit, wherein the control unit varies the distance between where the pressing unit contacts the sliding member and presses the guiding portion.

8. The recording apparatus according to claim 7, wherein the pressing unit is provided with a biasing member that generates a biasing force, and wherein the sliding member has cam portions that contact the pressing unit, wherein a force generated by the pressing unit contacting the guiding portion is changed depending on whether or not the biasing member is pushing the cam portions due to a position of the sliding member.

9. The recording apparatus according to claim 8, wherein a plurality of stepped portions with different heights are provided in the cam portions of the sliding member in a direction that intersects the first direction.

10. The recording apparatus according to claim 7, wherein a sliding resistance between the carriage and the guiding portion is change according to a movement speed of the carriage by making the distance between where the pressing unit contacts the sliding member and presses the guiding portion larger at a second carriage speed than the distance between where the pressing unit contacts he sliding member and pressing the guiding portion at a first carriage speed.

11. The recording apparatus according to claim 7, wherein a sliding resistance between the carriage and the guiding portion is change in states in which a movement speed of the carriage is the same according to a type of print medium on which the ink is ejected by making the distance between where the pressing unit contacts the sliding member and presses the guiding portion larger for a second print medium type than the distance between where the pressing unit contacts the sliding member and presses the guiding portion for a first print medium type.

* * * * *